US005197441A

United States Patent [19]

Green

[11] Patent Number: 5,197,441

[45] Date of Patent: Mar. 30, 1993

[54] FUEL INJECTION PUMPING APPARATUS

[75] Inventor: Alan C. Green, Maidstone, England

[73] Assignee: Lucas Industries, Birmingham, England

[21] Appl. No.: 759,850

[22] Filed: Sep. 16, 1991

Related U.S. Application Data

[63] Continuation of Ser. No. 532,220, Jun. 1, 1990, abandoned.

[30] Foreign Application Priority Data

Jun. 3, 1989 [GB] United Kingdom ..... 8912823

[51] Int. Cl.[5] ..... F02M 39/02; F04B 3/00

[52] U.S. Cl. ..... 123/502; 123/462; 417/462; 417/251

[58] Field of Search ..... 417/462, 251; 123/502, 123/462, 459, 450

[56] References Cited

U.S. PATENT DOCUMENTS

| | | | |
|---|---|---|---|
| 4,050,433 | 9/1977 | Tokashiki | 123/502 |
| 4,080,109 | 3/1978 | Green | 123/502 |
| 4,138,981 | 2/1979 | Green | 417/462 |
| 4,359,994 | 11/1982 | Hofer | 123/502 |
| 4,393,846 | 7/1983 | Mowbray | 123/502 |
| 4,475,521 | 10/1984 | Greiner | 123/502 |
| 4,619,238 | 10/1986 | Hain | 123/502 |
| 4,733,645 | 3/1988 | Hain | 123/502 |
| 4,796,592 | 1/1989 | Hofer | 123/502 |

*Primary Examiner*—Carl S. Miller
*Attorney, Agent, or Firm*—Abelman Frayne & Schwab

[57] ABSTRACT

A fuel pumping apparatus for supplying fuel to an internal combustion engine has an injection pump supplied with fuel by a low pressure feed pump through an adjustable throttle. A fluid pressure operable piston is movable against the action of a spring to control the timing of delivery of fuel by the injection pump. Fuel under pressure is applied to the piston through a first fixed orifice from the feed pump. A second fixed orifice and a variable orifice are connected in series between a drain and the downstream side of the first fixed orifice. In parallel with the first fixed orifice is a constant pressure drop valve which maintains the pressure drops across the first fixed orifice substantially constant when the pressure drop has risen to a predetermined value.

3 Claims, 2 Drawing Sheets

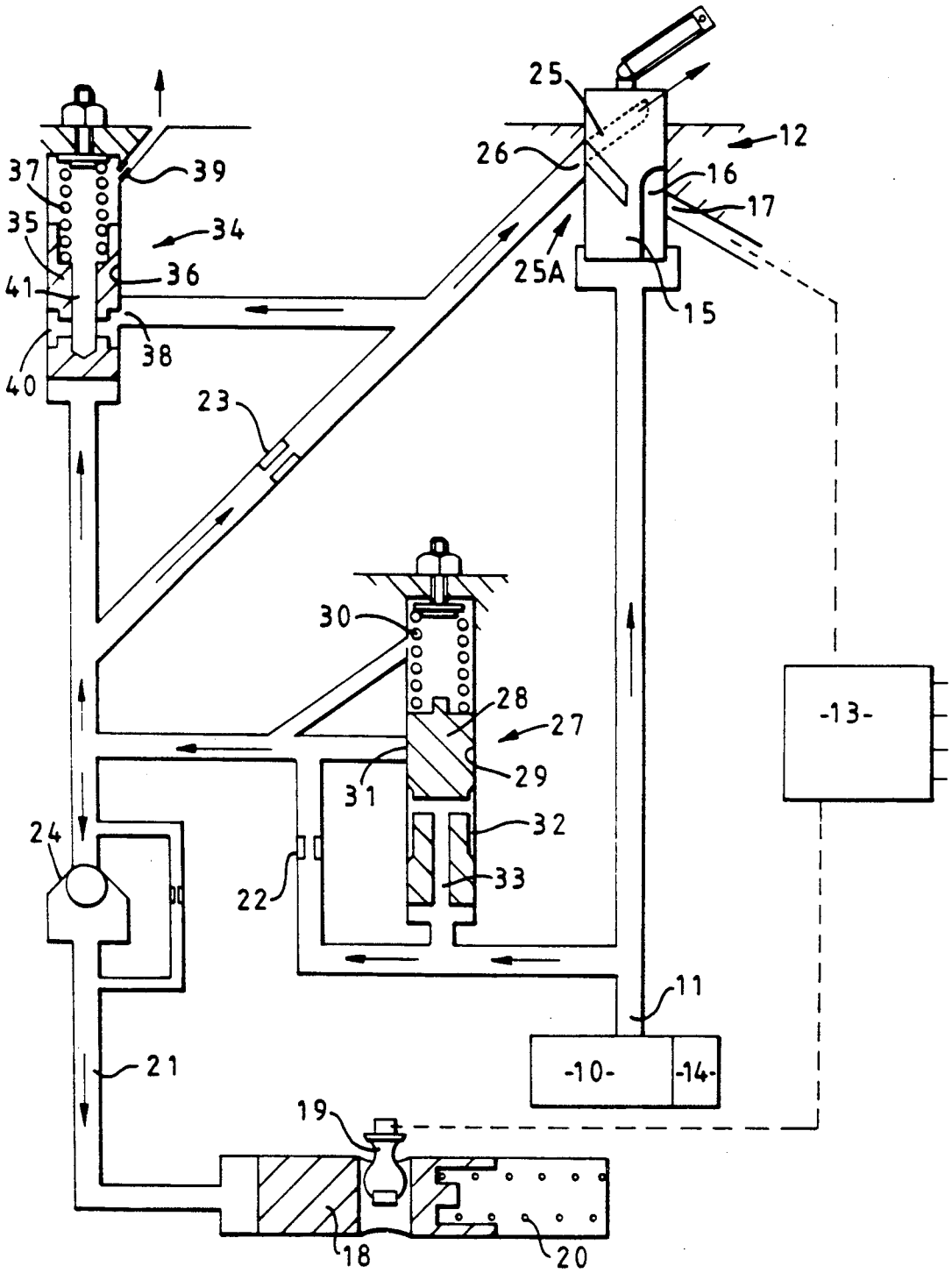
25
12
26
16
17
37
39
35
34
41
36
25A
15
40
38
23
30
28
27
-13-
31
29
32
24
22
33
11
21
-10-
-14-
19
18
20

FUEL INJECTION PUMPING APPARATUS

This application is a continuation of application Ser. No. 532,220, filed Jun. 1, 1990 now abandoned.

This invention relates to a fuel injection pumping apparatus for supplying fuel to an internal combustion engine the apparatus being of the kind comprising an injection pump for delivering fuel in timed relationship to an associated engine, a feed pump for supplying fuel to the injection pump during the filling periods thereof, the outlet pressure of said feed pump varying in accordance with the speed of the associated engine, throttle means for adjusting the amount of fuel supplied by the feed pump to the injection pump and fluid pressure operable means for adjusting a component of the injection pump to vary the timing of delivery of fuel to the associated engine.

The object of the present invention is to provide an apparatus of the kind specified in a simple and convenient form and in which adjustment of the timing of delivery of fuel can be obtained for varying settings of the throttle means.

According to the invention an apparatus of the kind specified comprises a first fixed orifice through which fuel from the outlet of the feed pump is applied to said fuel pressure operable means, a second fixed orifice through which fuel from downstream of said first fixed orifice can flow to a drain, a variable orifice connected in series with said second orifice, the size of said variable orifice being determined by the setting of said throttle means and a valve responsive to the pressure drop across said first fixed orifice and operable after the pressure drop has attained a predetermined value to maintain the pressure drop substantially constant.

An example of an apparatus in accordance with the invention will now be described with reference to the accompanying drawings in which:

FIG. 1 is a diagrammatic representation of the apparatus and

Figure 2A:
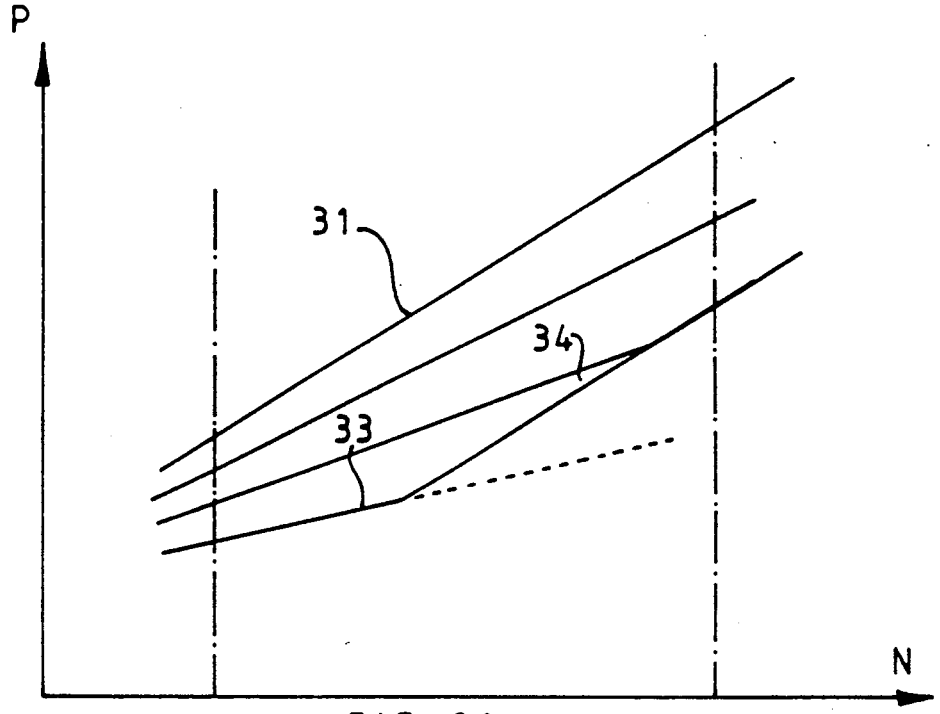
FIGS. 2A and 2B show the performance characteristics of the apparatus

With reference to FIG. 1 of the drawings the pumping apparatus comprises a high pressure injection pump generally indicated at 10 of the type having a rotary distributor member which is housed within housing of the apparatus, the distributor member being adapted to be driven in timed relationship with the associated engine. Formed in the distributor member is a transversely extending bore which accommodates a pair of pumping plungers which are moved inwardly as the distributor member rotates, by the co-operation of rollers at the outer ends of the plungers engaging with the internal periphery of an annular cam ring having formed on its internal periphery, pairs of inwardly extending cam lobes.

The fuel displaced by the injection pump during the injection strokes thereof is distributed in known manner in turn to injection nozzles associated with the combustion chambers of the associated engine.

The cam ring is angularly adjustable in order to determine the timing of delivery of fuel to the associated engine and for this purpose the cam ring is provided with a peg 11 which is engaged within a recess defined in a fluid pressure operable piston 12 which constitutes the aforesaid fluid pressure operable means. The piston is spring loaded by means of a spring 13 towards one end of the cylinder in which it is mounted. As the piston moves against the action of the spring the timing of delivery of fuel will be advanced.

The apparatus also includes a low pressure feed pump 14 conveniently having a rotary part which is mounted on the distributor member. The feed pump draws fuel from a convenient source not shown and the output pressure of the feed pump is controlled by valve means 15 so that as the speed of operation of the associated engine increases, the outlet pressure of the feed pump also increases.

The amount of fuel which is supplied by the injection pump 10 at each delivery stroke is determined by the amount of fuel which is supplied to it during the filling strokes, by the feed pump 14 and the fuel flowing to the injection pump is controlled by a throttle means 16. In the particular example the throttle means comprises an angularly adjustable throttle member 17 mounted within the housing of the apparatus and its angular setting is determined in part by a mechanical governor (not shown) which is responsive to the speed at which the apparatus is driven, and in part to the setting of an operator adjustable member. Conveniently the throttle member 17 is housed within a bore formed in the housing and it extends from the bore.

The inner end of the throttle member is subjected to the outlet pressure of the feed pump 14 and formed in the throttle member is an axial groove 18 which registers to a varying degree, with a port 19 formed in the wall of the cylinder in which the throttle member is mounted. The port 19 by way of further ports and passages in the body and distributor member, is brought into communication with the injection pump during the filling periods thereof. The angular setting of the throttle member therefore determines the amount of fuel which is supplied by the feed pump to the injection pump during the filling strokes thereof.

In order to adjust the timing of delivery of fuel the piston 12 is subjected to a varying fuel pressure. Fuel under pressure is derived from the outlet of the feed pump 14 but it is modified in accordance with the setting of the throttle means 16. The outlet of the feed pump communicates with the cylinder containing the piston 12 by way of a first fixed orifice 20 and the downstream side of this orifice is connected to the cylinder containing the piston by way of a valve 21 the purpose of which is to minimise so far as possible, movement of the piston by the reaction of the rollers with the cam lobes. A small bleed orifice is provided in parallel with the valve 21 to permit fuel to escape from the cylinder as the piston is moved by the spring 13.

The downstream side of the orifice 20 also communicates with a drain by way of a second fixed orifice 22 connected in series with a variable orifice 23 which is constituted by a port 24 in the wall of the cylinder in which the throttle member 17 is mounted and by an inclined groove 25 formed in the periphery of the throttle member and having one end communicating with the interior of the housing which forms the drain. It is arranged that as the throttle member 17 is moved angularly to increase the amount of fuel supplied to the engine, the degree of restriction offered by the variable orifice 23 decreases so that an increased flow of fuel takes place through the fixed orifices 20 and 22 with the result that the pressure applied to the piston 12 is reduced.

Also provided is a valve 26 which comprises a valve member 27 slidable within a cylinder 28. The opposite ends of the cylinder are connected to the upstream and downstream sides of the orifice 20, and formed in the wall of the cylinder is a port 29 which is connected to the downstream side of the orifice 20. The valve member is biased by a spring 29A towards the one end of the cylinder connected to the upstream side of the orifice 20 and formed in the valve member is a circumferential groove 30 which is connected to said one end of the cylinder.

In use, when the throttle member is set to allow the minimum flow of fuel to the associated engine the port 24 will be closed with the result that there will be no flow of fuel through the orifices to drain and the pressure applied to the piston 12 will be the full outlet pressure of the feed pump 14 as indicated at 31 in FIG. 2A in which the speed N is plotted against the pressure P applied to the piston. The resulting movement of the piston 12 is indicated at 32 in FIG. 2B in which the speed N is plotted against the piston movement or timing advance A. The movement of the piston 12 against the action of the spring 13 takes place as soon as the engine is started and the full range of movement of the piston is completed in the example, by about half way through the speed range of the engine. In the two diagrams the left hand vertical line indicates the idling speed of the engine and the right hand vertical line the maximum engine speed.

When the throttle member is set to allow the maximum flow of fuel to the associated engine the port 24 is effectively open fully and the pressure of fuel which is applied to the piston 12 will depend upon the sizes of the orifices 20 and 22. As shown at 33 in FIG. 2A the pressure will be lower than the outlet pressure of the transfer pump due to the potentiometer effect of the orifices. The valve member 27 of the valve 26 is subject to the pressure drop across the orifice 20 and in response to the pressure drop will move against the action of the spring 29A. The movement of the valve member will have no effect until the groove 30 moves into register with the port 29 thereafter the valve 26 acts to maintain a constant pressure drop across the orifice 20 so that as seen at 34 in FIG. 2A the pressure applied to the piston 12 increases at the same rate as the output pressure of the feed pump 14 but at a fixed value below this pressure. The position of the piston 12 is indicated at 35 and 36 in FIG. 2B. In fact portion 35 shows no movement of the piston since the pressure applied to it is insufficient to overcome the force exerted by the spring 13. Movement of the piston does not start to take place under full load conditions until after the valve 26 has started to function.

Figure 2B:
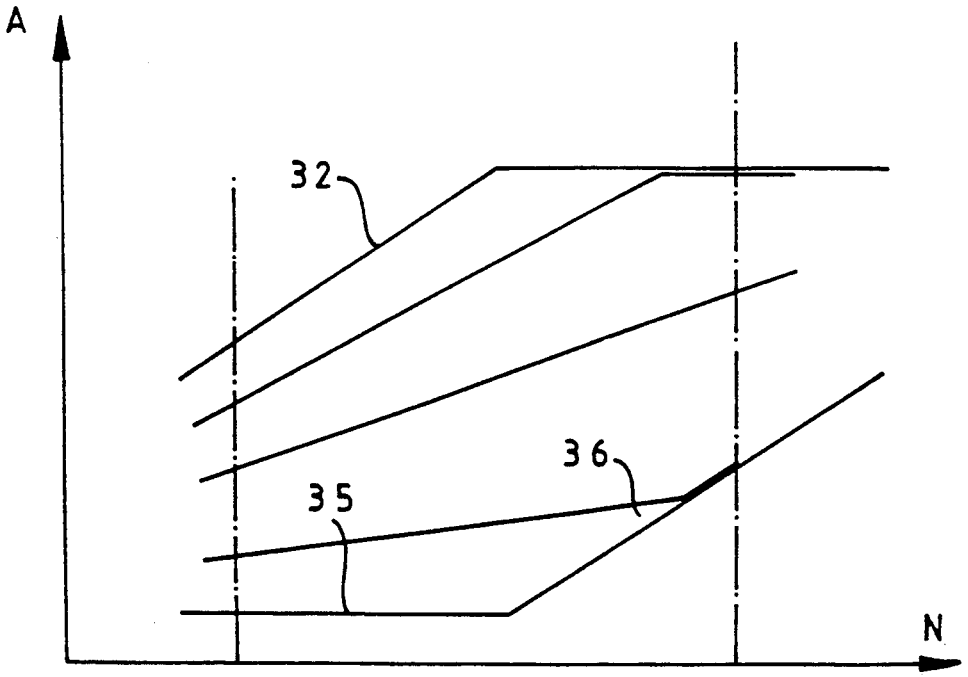

As the amount of fuel delivered to the engine is decreased the port 24 and the groove 25 act as an orifice so that the pressure applied to the piston 12 will be increased. The reduced flow of fuel through the orifice 20 means that the pressure drop across the orifice will be reduced and therefore the valve 26 will not come into operation until a higher engine speed is attained. In FIGS. 2A and 2B the intermediate curves show the performance curves over the engine speed range at different constant settings of the throttle.

In the arrangement shown in FIG. 1 the orifice 22 can be positioned downstream of the variable orifice 23. For this purpose the projecting end of the throttle member 17 would be enclosed by an end casing in which would be formed the orifice 22 as an alternative to the groove 25 instead of extending into the exposed portion of the throttle member 17 can terminate in a circumferential groove on the throttle member and which is in permanent communication with a drain port in the wall of the bore in which the throttle member 17 is mounted, the port incorporating the orifice 22. Alternatively the groove 25 may communicate with a drilling formed in the throttle member and incorporating the orifice 22.

I claim:

1. A fuel injection pumping apparatus for supplying fuel to an internal combustion engine, comprising:

an injection pump for delivering fuel in timed relationship to an associated engine, a feed pump for supplying fuel to the injection pump during the filling periods thereof, the outlet pressure of said feed pump varying in accordance with the speed of the associated engine, throttle means for adjusting the amount of fuel supplied by the feed pump to the injection pump, and, fluid pressure operable means for adjusting a component of the injection pump to vary the timing of delivery of fuel to the associated engine, a first fixed orifice connected in a first fuel path extending between the outlet of the feed pump and said fluid pressure operable means, a second fuel path extending from downstream of said first fixed orifice to a drain, said second fuel path incorporating a variable orifice the size of which is determined by the setting of said throttle means and a second fixed orifice connected in series, so that all the fuel which flows through the second fixed orifice flows through the variable orifice, and, a valve responsive only to the pressure drop across the first fixed orifice and operable after the pressure drop has attained a predetermined value, to maintain the pressure drop across the first fixed orifice substantially constant.

2. An apparatus according to claim 1, characterized in that the second fixed orifice is positioned upstream of said variable orifice.

3. An apparatus according to claim 1, in which the second fixed orifice is positioned downstream of said variable orifice.

* * * * *